United States Patent [19]

Maldonado

[11] Patent Number: 5,048,796

[45] Date of Patent: Sep. 17, 1991

[54] SHEET ROCK REPAIR JACK

[76] Inventor: Alvin R. Maldonado, 912 Johnsòn St., Fairfield, Calif. 94533

[21] Appl. No.: 581,918

[22] Filed: Sep. 13, 1990

[51] Int. Cl.[5] ..... B66F 3/36

[52] U.S. Cl. ..... 254/100; 254/133 A

[58] Field of Search ..... 254/100, 98, 133 A, 254/DIG. 1, DIG. 4; 29/239; 248/354 P, 354 S, 354 R

[56] References Cited

U.S. PATENT DOCUMENTS 2,762,599 9/1956 Faris ..... 254/100

3,880,394 4/1975 Wisecarver ..... 254/100

*Primary Examiner*—Robert C. Watson

*Attorney, Agent, or Firm*—William S. Bernheim

[57] ABSTRACT

A jack for insertion through a hole in a sheetrock wall for use in repairing such hole with the jack becoming a structural member of such wall.

1 Claim, 1 Drawing Sheet

SHEET ROCK REPAIR JACK

BACKGROUND OF THE INVENTION

1. Field of the Invention

The present invention relates to a jack to be used in the repair of holes made in sheet rock walls.

2. Description of the Prior Art

Sheet rock is a type of wall building material which has been used for more than four decades. A typical sheet size is 4 foot by 8 foot with a thickness between ⅜ inch to ¾ inch. Internal walls are typically built by nailing or screwing sheet rock to framing studs placed vertically with a spacing of 16 inches center to center. The depth of the stud is between 3 and 4 inches and the width 1 ½ to 2 ½ inches. When sheet rock is attached on both sides of the stud a hollow space is formed between adjacent studs. The hollow space is about 3 to 4 inches in depth and 14 inches in width and the height of the wall. Wiring and plumbing passes as needed through the hollow space. Cross members between adjacent studs are sometimes used for fire breaks and for structural strength.

Repair of a damaged sheet is a problem. Replacement of the entire sheet is possible but expensive. At the edges of adjoining sheets taping is needed to give a smooth surface. Replacement of an entire sheet involves 24 feet of taping and 32 square feet of painting to match color. Preferably the repair is limited to the damaged area. The damaged area is cut out and enlarged as needed. In other words, the damaged sheet rock is removed which leaves a hole. An insert is prepared with the shape of the hole. The insert is typically cut from an unused piece of sheet rock. Numerous methods are used to position and give strength to the insert; because of drawbacks none is suitable for all needs. For strength the insert must be supported from behind inside the wall to have a surface flush with the remaining undamaged sheet rock surface and not be pushed inward if reasonable pressure is applied to the wall at the location of the insert. Additional studs or cross members to provide the support in the area of the damage is expensive, cumbersome and may not be practical because of wires and other items found within the wall.

3. Statement of the Objects

Accordingly, it is an objective of the present invention to provide a jack for providing a means for positioning an insert used to repair a damaged wall built with sheet rock.

Other objectives, advantages and novel features of the invention will become apparent to those skilled in the art upon examination of the invention and the accompanying drawings.

SUMMARY OF THE INVENTION

BRIEF DESCRIPTION OF THE DRAWINGS

Further objectives and advantages of the invention will be apparent from the following detailed description, taken in conjunction with the accompanying drawings illustrating a preferred embodiment of the invention. The drawings are.

DETAILED DESCRIPTION OF A PREFERRED EMBODIMENT

Figure 1:
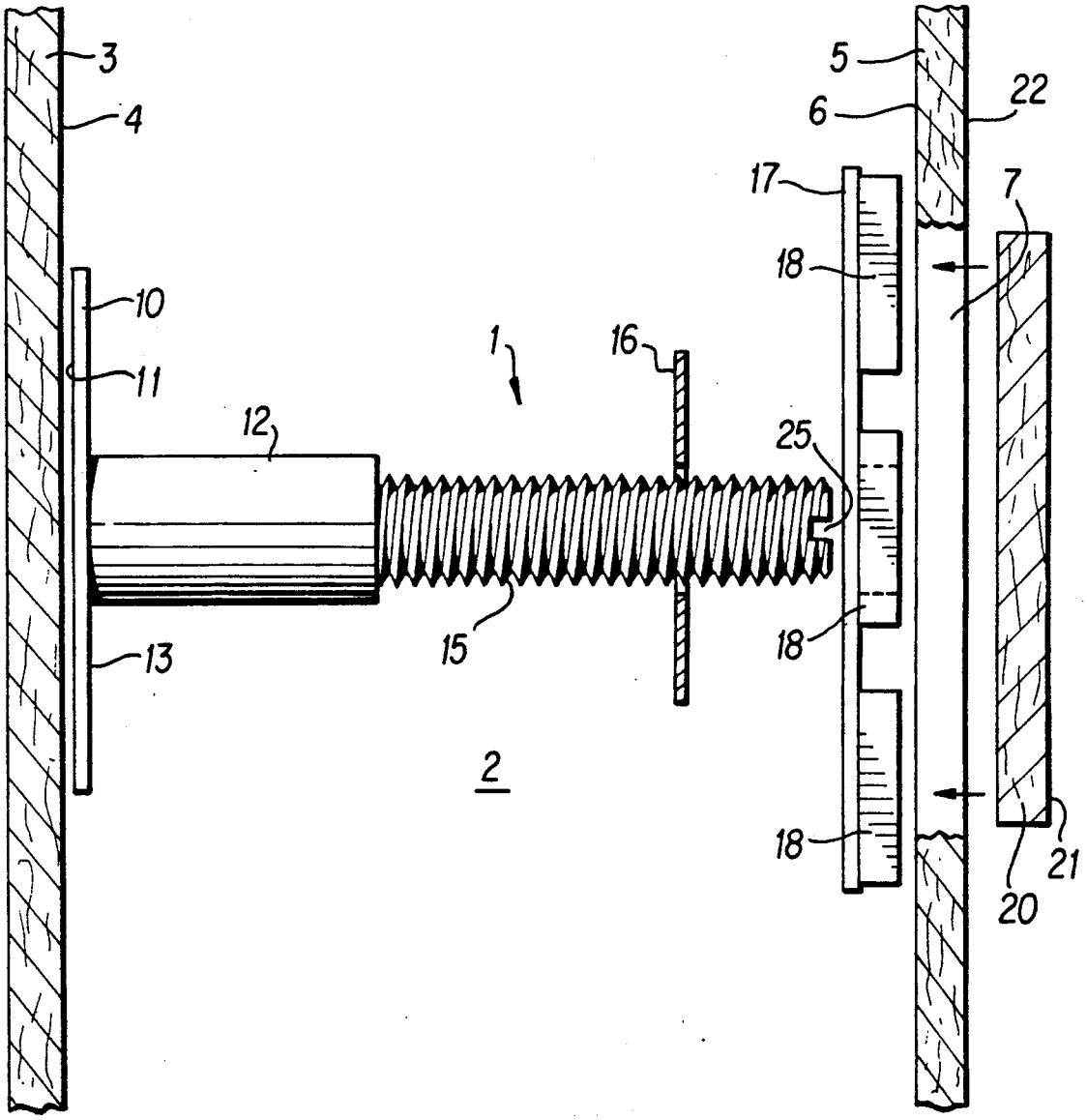
FIG. 1 is a side view of a sheet rock repair jack in accordance with the invention.

In FIG. 1, a sheet rock repair jack 1 is shown placed within an interior frame area 2 formed by vertical studs, not shown, of at least three inches in depth, an outside or opposite wall 3 having an internal surface 4 and a first or inside wall 5 constructed of sheet rock and having an internal surface 6. The first wall 5 has a hole 7 resulting from damage or otherwise. If necessary the hole 7 is enlarged to sufficient size to allow the jack 1 to pass through the hole 7 and to be placed and assembled within the interior frame area 2.

The jack 1 includes a thin base 10 having a distal surface 11 which is flat for placing against the internal surface 5 of the outside wall 3. The base 10 is preferably a flat piece of metal of about ⅜ inch thickness or wood or plastic of about ⅜ inch thickness. The distal surface 11 is preferable coated with an adhesive with a pull away cover. The cover is removed just prior to placing the distal surface 11 against the internal surface 5 so that the adhesive helps to hold the jack in position. The area of the surface of the base 10 is about 2 square inches but should be increased if the area of the hole 5 is more than about 5 square inches. The shape of the base 10 can be circular or rectangular.

A metal barrel 12 is attached to the inner surface 13 of the base 10 preferably by welding, to extend perpendicularly from the base 10. A rod 15 is mounted to telescope with the barrel to provide the jack 1 with a depth adjustment. Preferably the barrel 12 is internally threaded and the rod 15 externally threaded.

An apron 16 such as a washer is attached to the rod 15. A frame 17 is engaged with the apron 16 and the rod 15 to provide support for one or more slats 18.

One or more of the slats 18 is longer than the width of the hole 7. The slats 18 are first placed within the interior space and then positioned on the frame so that each end of at least one slat 18 engages the internal surface 6 of the first wall 5 to provide a back support by defining a flat surface level with the internal surface 6 of the sheet rock of the first wall 5 so that a sheet rock insert 20 shaped and slightly smaller than the hole 7 can be attached to the slats 18 to have the exterior surface 21 of the insert 20 level with the exterior surface 22 of the sheet rock of the first wall 5.

A pressure means 25 is provided so that the rod 15 is adjusted relative to the barrel 12 to securely position the jack 1 by causing the base 10 to assert a pressure on the internal surface 4 of the outside wall 3 and a slat 18 to assert a pressure on the internal surface 6 of the first wall 5. The pressure means 21 can be a slot cut in the head of the rod 15 so that the head of a screw driver can be use to turn the rod 15. Alternatively, a bolt is used as the rod and the head serves as the pressure means 25. Further a nut screwed onto to the rod 15 and secured by welding or the like to the rod 15 can serve as the pressure means 25. Turning of the slot, bolt head or nut turns the threaded rod 15 to cause the distance between the base and frame to increase or decrease.

I claim:

1. A sheet rock repair jack for use in repairing a wall constructed with sheet rock, a first wall, a second wall and a space there between of at least three inches, the jack comprising of:

a base having a flat surface for engaging the internal surface of the second wall, a barrel attached to the distal surface from the flat surface of the base, a rod mounted to telescope with the barrel to provide the jack with a depth adjustment, an apron attached to the rod, a frame engaged with the apron and rod to provide support for a slat, a pressure means for adjusting the rod relative to the barrel to securely position the jack between the second wall and sheet rock wall by causing the base to assert a pressure on the internal surface of the second wall and the slat to assert a pressure on the internal surface of the sheet rock wall and the pressure means including an adjusting means operable through the frame and at the end of the rod distal from the base.

* * * * *